US007051402B1

(12) United States Patent
Rigby

(10) Patent No.: US 7,051,402 B1
(45) Date of Patent: May 30, 2006

(54) GUTTER SWEEPER SYSTEM

(76) Inventor: Robert B. Rigby, P.O. Box 83, Nokomis, FL (US) 34274

( * ) Notice: Subject to any disclaimer, the term of this patent is extended or adjusted under 35 U.S.C. 154(b) by 0 days.

(21) Appl. No.: 11/063,710

(22) Filed: Feb. 23, 2005

(51) Int. Cl.
*A47L 9/04* (2006.01)

(52) U.S. Cl. ..... 15/340.1; 15/349; 15/83

(58) Field of Classification Search ..... 15/387, 15/340.1, 340.3, 340.4, 349, 375, 376, 82, 15/83
See application file for complete search history.

(56) References Cited

U.S. PATENT DOCUMENTS 1,323,925 A * 12/1919 Stewart ..... 15/375
1,718,293 A * 6/1929 Hoover ..... 15/376
2,178,003 A * 10/1939 Smellie ..... 15/375
4,620,341 A * 11/1986 Rigby ..... 15/340.3
5,802,666 A * 9/1998 Jung ..... 15/387
5,884,359 A * 3/1999 Libhart ..... 15/340.3
6,314,611 B1 * 11/2001 Sauers ..... 15/376

* cited by examiner

*Primary Examiner*—Theresa T. Snider
(74) *Attorney, Agent, or Firm*—Edward P. Dutkiewicz

(57) ABSTRACT

A vehicle has a container that receives swept debris. A primary sweeper assembly has a primary axle with wound cables in a helical configuration. A primary shroud supports the primary sweeper assembly and the axle adjacent to its ends. Disk-shaped turbines are mounted on the axle within the shroud. A turbine is located adjacent to each end of the axle with a primary tube there above. A supplemental shroud encompasses the primary shroud. A supplemental turbine is coupled to and rotatable with the primary axle with a secondary tube.

6 Claims, 4 Drawing Sheets

FIG 1
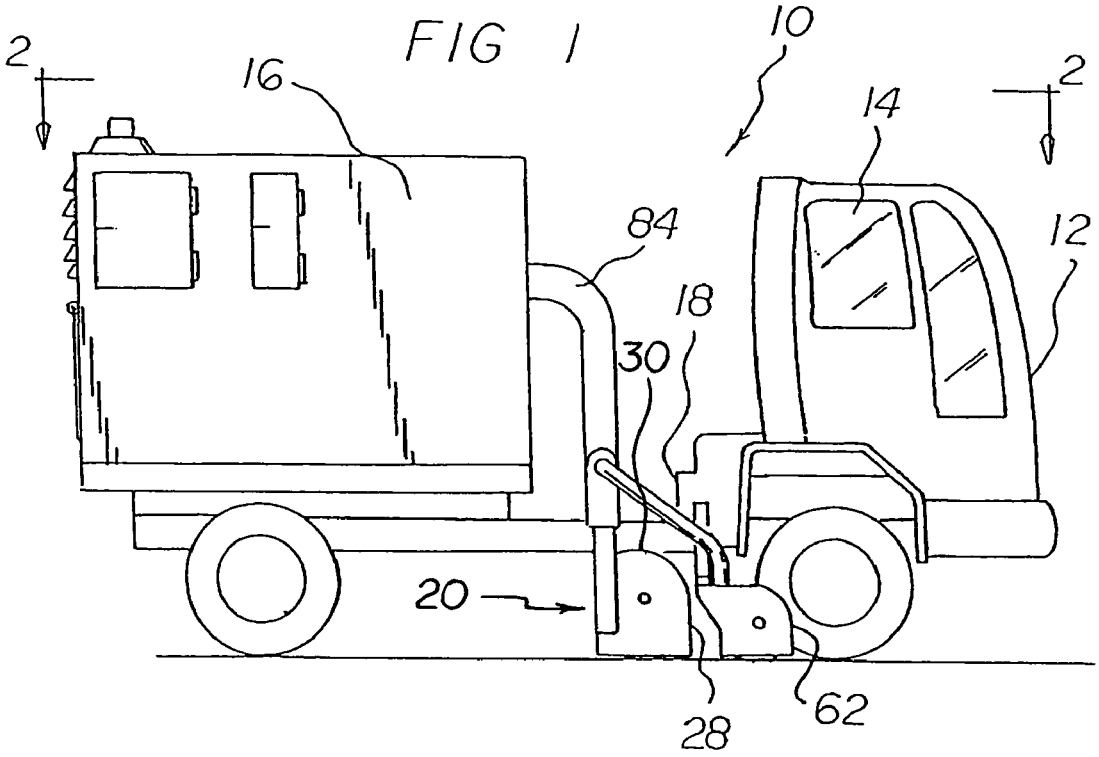
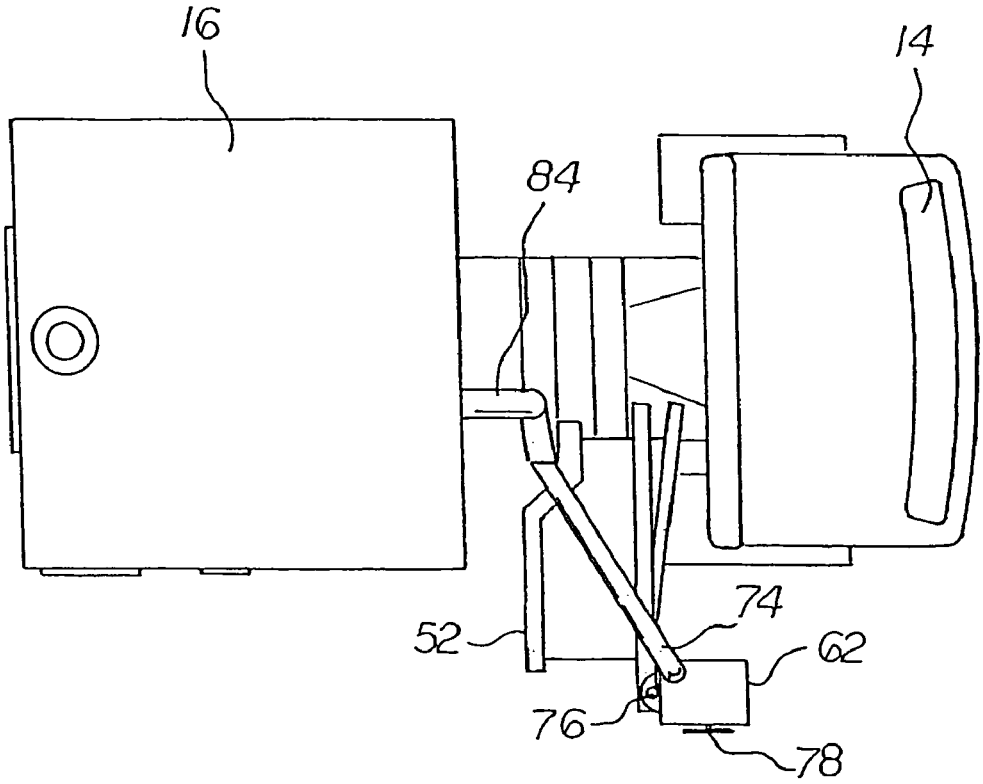
FIG 2

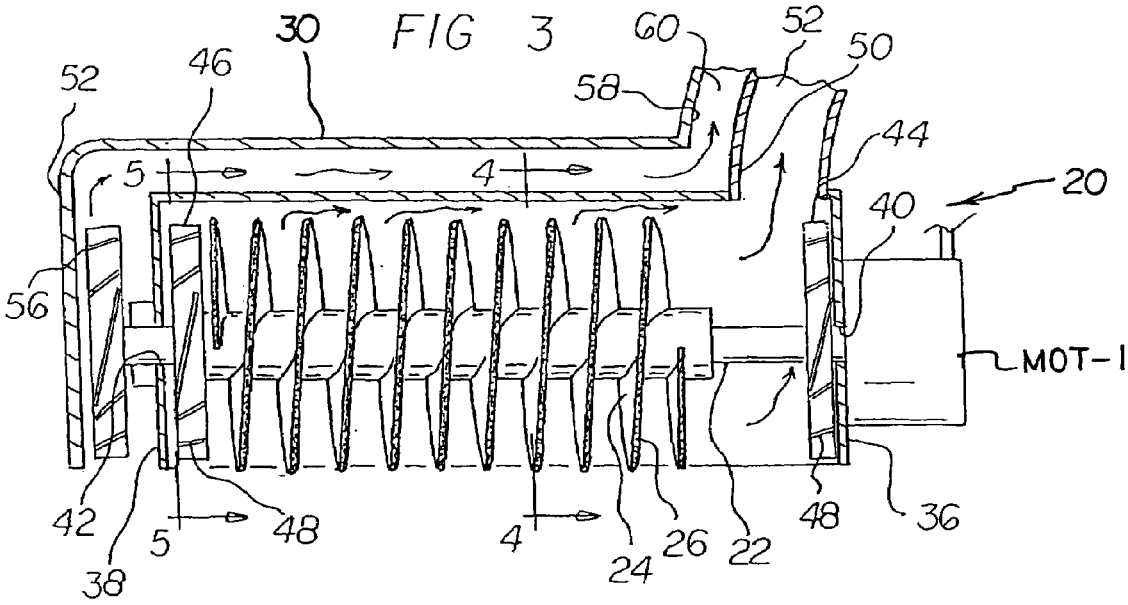
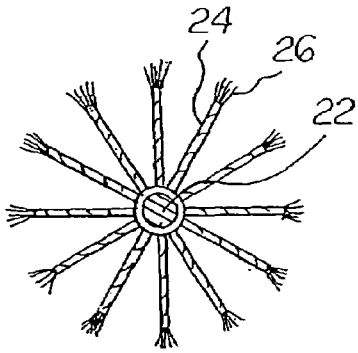
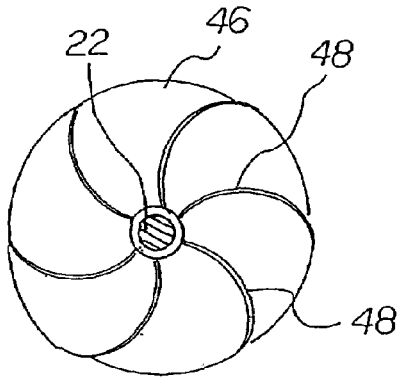
FIG 4 FIG 5

FIG 6
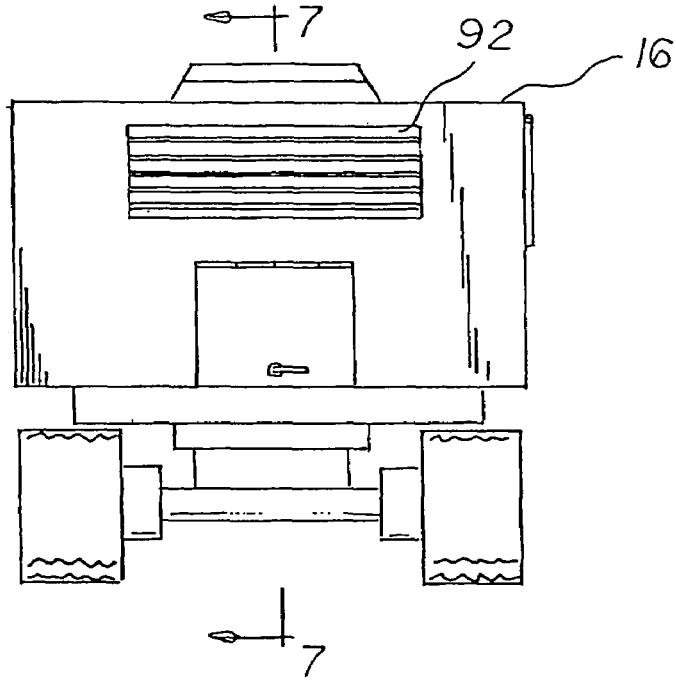
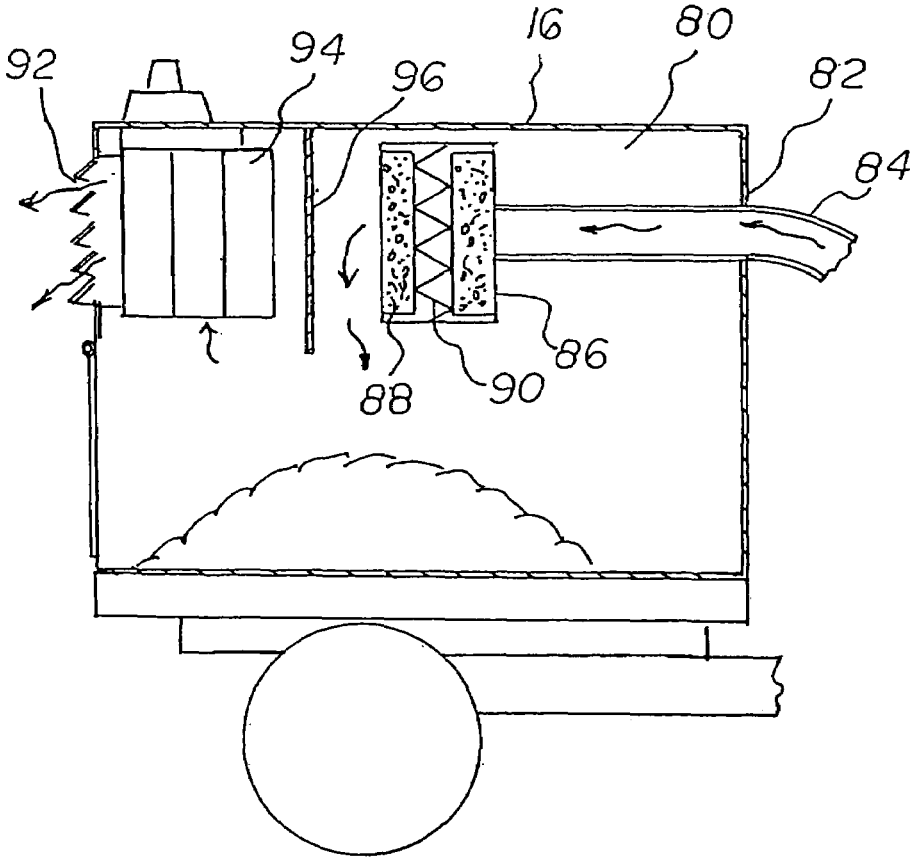
FIG 7

FIG 8
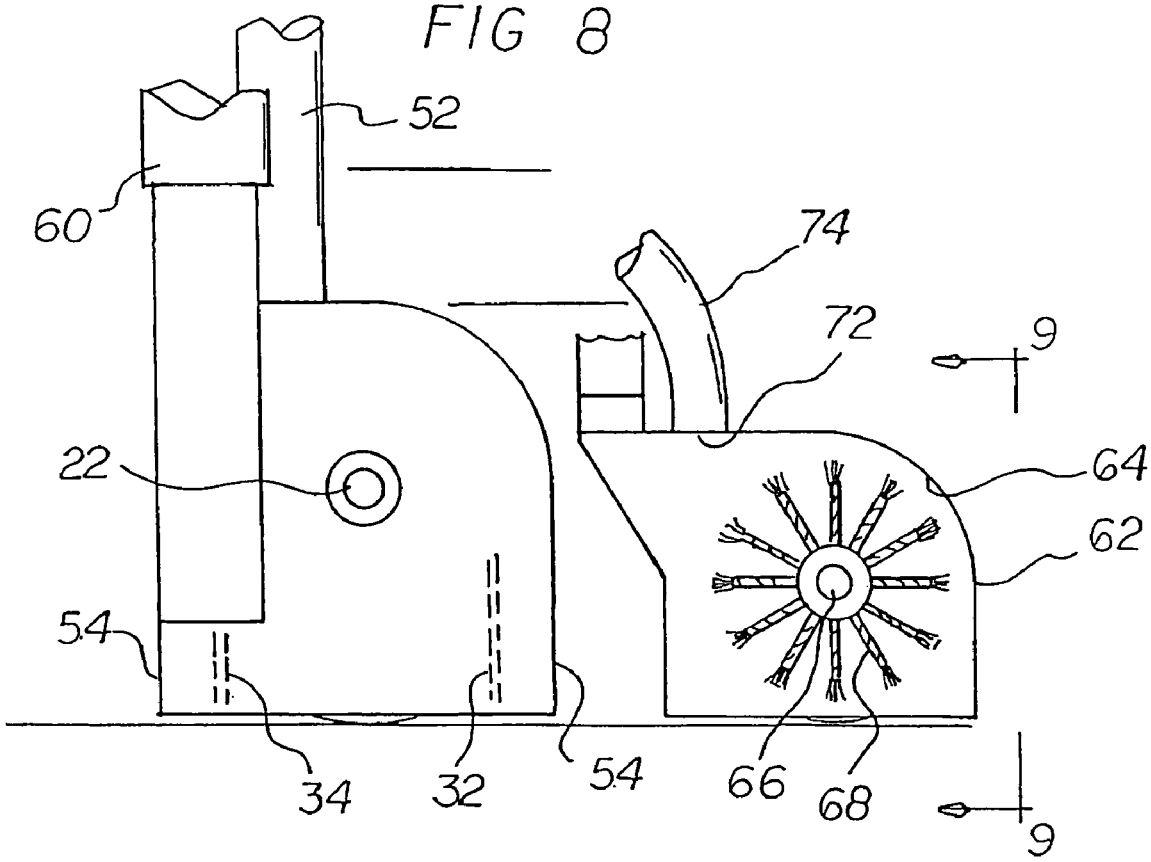
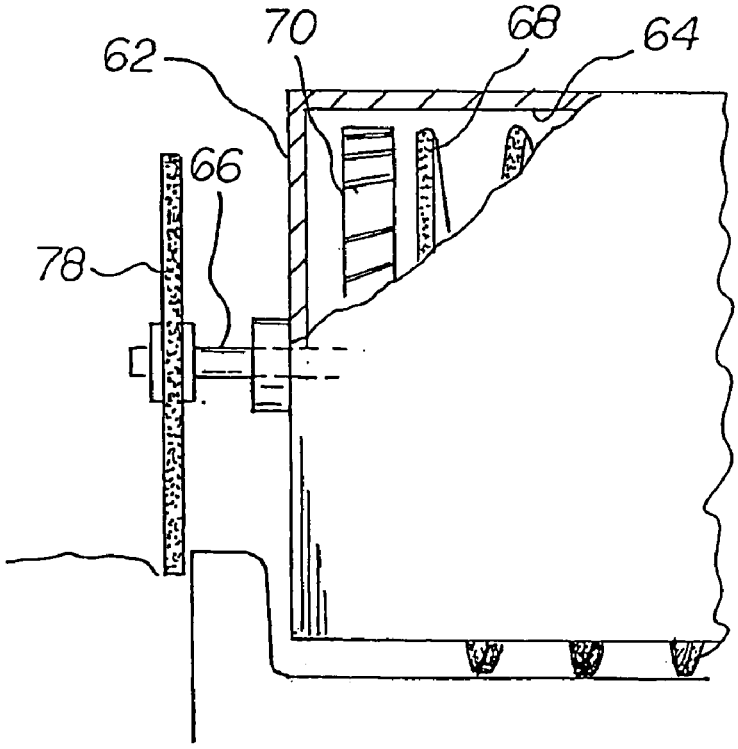
FIG 9

GUTTER SWEEPER SYSTEM

BACKGROUND OF THE INVENTION

1. Field of the Invention

The present invention relates to a gutter sweeper system and more particularly pertains to sweeping gutters and optionally sweeping the adjacent curb and trimming and edge there adjacent in a convenient and ecologically sound manner.

2. Description of the Prior Art

The use of cleaning apparatuses of known designs and configurations is known in the prior art. More specifically, cleaning apparatuses of known designs and configurations previously devised and utilized for the purpose of sweeping and trimming through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,620,341 issued to Rigby Nov. 4, 1986 relates to a curb and gutter machine and U.S. Pat. No. 5,884,359 issued to Libhart Mar. 23, 1999 relates to a surface cleaning apparatus.

While these devices fulfill their respective, particular objectives and requirements, the aforementioned patents do not describe gutter sweeper system that allows sweeping gutters and optionally sweeping the adjacent curb and trimming and edge there adjacent in a convenient and ecologically sound manner.

In this respect, the gutter sweeper system according to the present invention substantially departs from the conventional concepts and designs of the prior art, and in doing so provides an apparatus primarily developed for the purpose of sweeping gutters and optionally sweeping the adjacent curb and trimming and edge there adjacent in a convenient and ecologically sound manner.

Therefore, it can be appreciated that there exists a continuing need for a new and improved gutter sweeper system which can be used for sweeping gutters and optionally sweeping the adjacent curb and trimming and edge there adjacent in a convenient and ecologically sound manner. In this regard, the present invention substantially fulfills this need.

SUMMARY OF THE INVENTION

In view of the foregoing disadvantages inherent in the known types of cleaning apparatuses of known designs and configurations now present in the prior art, the present invention provides an improved gutter sweeper system. As such, the general purpose of the present invention, which will be described subsequently in greater detail, is to provide a new and improved gutter sweeper system and method which has all the advantages of the prior art and none of the disadvantages.

To attain this, the present invention essentially comprises a vehicle. The vehicle has a front with a cab. The cab supports an operator. The vehicle has a rear with a container. The container receives swept and trimmed debris. An intermediate section is provided between the front and rear.

A primary sweeper assembly is provided. The primary sweeper assembly is adapted to clean a gutter. The primary sweeper assembly has a primary axle. The primary axle is horizontally disposed and cylindrically shaped. The primary axle is rotatable. The primary axle has wound cables. The cables are arranged in a helical configuration. The cables have interior ends. The interior ends are secured to and rotatable with the axle. The cables have exterior ends. The exterior ends are formed as tips of frayed cables.

A primary shroud is provided next. The primary shroud is secured to the vehicle on one side of the intermediate section. The primary shroud supports the primary sweeper assembly. The primary shroud has an upper portion. The upper portion is in a generally semi-cylindrical configuration. The primary shroud has parallel front, rear portions and end portions. The end portions have aligned apertures. The end portions support the axle adjacent to its ends.

Provided next are two disk-shaped turbines. The turbines are mounted on the axle within the shroud. A turbine is located adjacent to each end of the axle. Each turbine includes arcuate blades. The arcuate blades create a flow of air upwardly from the gutter being swept. An opening is provided in the primary shroud above one end of the axle. A primary tube is provided. The primary tube is above the opening.

A supplemental shroud is provided. The supplemental shroud is in a configuration corresponding to and encompassing the primary shroud. The supplemental shroud has a supplemental turbine. The supplemental turbine is within the supplemental shroud. The supplemental turbine is coupled to and rotatable with the primary axle. In this manner dust may be entrapped and conveyed from the gutter adjacent to primary shroud. The supplemental shroud has a secondary aperture. The supplemental shroud has a secondary tube. The secondary tube is above the secondary aperture.

Next provided is an optional sweeper assembly. The optional sweeper assembly is adapted to clean a curb. The optional sweeper assembly has a supplemental housing. The supplemental housing is laterally spaced outboard of the sweeper assembly. The optional sweeper assembly has a supplemental axle. The supplemental axle has rotatable cables. The cables are constructed of cables with frayed ends. The cables are configured in a spiral as the primary sweeper assembly. The optional sweeper assembly has a turbine. The turbine is configured as the turbines on the primary axle. The supplemental housing has an aperture. The supplemental housing has a tertiary tube. The tertiary tube carries away debris. The optional sweeper assembly has a vertical pivot pin. The pin supports the optional sweeper assembly in a removable and adjustable manner.

A rotatable trimmer is provided. The trimmer is secured to the supplemental axle outboard of supplemental housing. The trimmer cuts soil, grass and weeds adjacent to the curb being swept.

Further provided is a chamber. The chamber is within the container. The chamber has an input aperture. The chamber has a collection tube. The collection tube receives the material from the primary, secondary and tertiary tubes. Open-cell foam blocks are provided. A primary filter is formed. The primary filter is formed of a first and second open-cell foam block. The primary filter entraps smaller particles of debris and allows larger particles to fall to the bottom of the housing. The foam blocks have an apertured spacer. The apertured spacer is in an accordion shape between the foam blocks.

Provided last is a final filter assembly. The final filter assembly has an opening in the upper rearward extent of the container. The final filter assembly has an electrostatic filter. The electrostatic filter entraps particulate matter. The particulate matter would otherwise be conveyed to the atmosphere. The container also includes a vertical baffl. The vertical baffle extends downwardly from the top of the container. The vertical baffle separates the foam blocks from the electrostatic filter.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved gutter sweeper system which has all of the advantages of the prior art cleaning apparatuses of known designs and configurations and none of the disadvantages.

It is another object of the present invention to provide a new and improved gutter sweeper system which may be easily and efficiently manufactured and marketed.

It is further object of the present invention to provide a new and improved gutter sweeper system which is of durable and reliable constructions.

An even further object of the present invention is to provide a new and improved gutter sweeper system which is susceptible of a low cost of manufacture with regard to both materials and labor, and which accordingly is then susceptible of low prices of sale to the consuming public, thereby making such gutter sweeper system economically available.

Even still another object of the present invention is to provide a gutter sweeper system for sweeping gutters and optionally sweeping the adjacent curb and trimming and edge there adjacent in a convenient and ecologically sound manner.

Lastly, it is an object of the present invention to provide a new and improved gutter sweeper system. A vehicle has a container. The container receives swept debris. A primary sweeper assembly has a primary axle with wound cables in a helical configuration. A primary shroud supports the primary sweeper assembly and the axle adjacent to its ends. Disk-shaped turbines are mounted on the axle within the shroud. A turbine is located adjacent to each end of the axle with a primary tube. A supplemental shroud encompasses the primary shroud. A supplemental turbine is coupled to and rotatable with the primary axle with a secondary tube there above.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is the side elevational view of a gutter sweeper system constructed in accordance with the principles of the present invention.

FIG. 2 is a plan view of the system taken along line 2—2 of FIG. 1.

FIG. 3 is a cross sectional view of the sweeper taken along line 3—3 of FIG. 2.

FIG. 4 is a cross sectional view taken along line 4—4 of FIG. 3.

FIG. 5 is a cross sectional view taken along line 5—5 of FIG. 3.

FIG. 6 is a rear elevational view of the system shown in FIGS. 1 and 2.

FIG. 7 is a cross sectional view taken along line 7—7 of FIG. 6.

FIG. 8 is an enlarged side elevational view of the central portion of the system of FIG. 1.

FIG. 9 is a front elevational view taken along line 9—9 of FIG. 9.

The same reference numerals refer to the same parts throughout the various Figures including the various alternative embodiments of the present invention.

DESCRIPTION OF THE PREFERRED EMBODIMENT

With reference now to the drawings, and in particular to FIG. 1 thereof, the preferred embodiment of the new and improved gutter sweeper system embodying the principles and concepts of the present invention and generally designated by the reference numeral 10 will be described.

The present invention, the gutter sweeper system 10 is comprised of a plurality of components. Such components in their broadest context include a vehicle, a primary sweeper assembly, a primary shroud, disk-shaped turbines, and a supplemental shroud. Such components are individually configured and correlated with respect to each other so as to attain the desired objective.

First provided is a vehicle 12. The vehicle has a front with a cab 14. The cab supports an operator. The vehicle has a rear with a container 16. The container receives swept and trimmed debris. An intermediate section 18 is provided between the front and rear.

A primary sweeper assembly 20 is provided. The primary sweeper assembly is adapted to clean a gutter. The primary sweeper assembly has a primary axle 22. The primary axle is horizontally disposed and cylindrically shaped. The primary axle is rotatable. The primary axle has wound cables 24. The cables are arranged in a helical configuration. The cables have interior ends. The interior ends are secured to and rotatable with the axle. The cables have exterior ends. The exterior ends are formed as tips 26 of frayed cables.

A primary shroud 28 is provided next. The primary shroud is secured to the vehicle on one side of the intermediate section. The primary shroud supports the primary sweeper assembly. The primary shroud has an upper portion 30. The upper portion is in a generally semi-cylindrical configuration. The primary shroud has parallel front, rear portions 32, 34 and end portions 36, 38. The end portions have aligned apertures 40, 42. The end portions support the axle adjacent to its ends.

Provided next are two disk-shaped turbines 44, 46. The turbines are mounted on the axle within the shroud. A turbine is located adjacent to each end of the axle. Each turbine includes arcuate blades 48. The blades 48 of turbines 44, 46 rotate due to the rotation of shaft 22 upon which they are mounted. Such rotation is in response to activation of motor MOT-1. Note FIG. 3. The arcuate blades create a flow of air upwardly from the gutter being swept. An opening 50 is provided in the primary shroud above one end of the axle. A primary tube 52 is provided. The primary tube is above the opening.

A supplemental shroud 54 is provided. The supplemental shroud is in a configuration corresponding to and encompassing the primary shroud. The supplemental shroud has a supplemental turbine 56. The supplemental turbine is within the supplemental shroud. The supplemental turbine is coupled to and rotatable with the primary axle. In this manner dust may be entrapped and conveyed from the gutter adjacent to primary shroud. The supplemental shroud has a secondary aperture 58. The supplemental shroud has a secondary tube 60. The secondary tube is above the secondary aperture.

Next provided is an optional sweeper assembly 62. The optional sweeper assembly is adapted to clean a curb. The optional sweeper assembly has a supplemental housing 64. The supplemental housing is laterally spaced outboard of the sweeper assembly. The optional sweeper assembly has a supplemental axle 66. The supplemental axle has rotatable cables 68. The cables are constructed of cables with frayed ends. The cables are configured in a spiral as the primary sweeper assembly. The optional sweeper assembly has a turbine 70. The turbine is configured as the turbines on the primary axle. The supplemental housing has an aperture 72. The supplemental housing has a tertiary tube 74. The tertiary tube carries away debris. The optional sweeper assembly has a vertical pivot pin 76. The pin supports the optional sweeper assembly in a removable and adjustable manner.

A rotatable trimmer 78 is provided. The trimmer is secured to the supplemental axle outboard of supplemental housing. The trimmer cuts soil, grass and weeds adjacent to the curb being swept.

Further provided is a chamber 80. The chamber is within the container. The chamber has an input aperture 82. The chamber has a collection tube 84. The collection tube receives the material from the primary, secondary and tertiary tubes. Open-cell foam blocks 86, 88 are provided. A primary filter is formed. The primary filter is formed of a first and second open-cell foam block 86, 88. The primary filter entraps smaller particles of debris and allows larger particles to fall to the bottom of the housing. The foam blocks have an apertured spacer 90. The apertured spacer is in an accordion shape between the foam blocks.

Provided last is a final filter assembly. The final filter assembly has an opening 92 in the upper rearward extent of the container. The final filter assembly has an electrostatic filter 94. The electrostatic filter entraps particulate matter. The particulate matter would otherwise be conveyed to the atmosphere. The container also includes a vertical baffle 96. The vertical baffle extends downwardly from the top of the container. The vertical baffle separates the foam blocks from the electrostatic filter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gutter street sweeper system comprising:

a vehicle having a container for receiving swept debris;

a primary sweeper assembly having a primary axle with wound cables arranged along the axle in a helical configuration;

a primary shroud supporting the primary sweeper assembly adjacent to its ends and having an opening in fluid communication with a primary tube to receive debris swept into the primary shroud;

disk-shaped turbine mounted on each end of the axle within the shroud;

a supplemental shroud encompassing the primary shroud and having a supplemental turbine coupled to and rotatable with the primary axle and having a secondary aperture in fluid communication with a secondary tube to receive debris swept into the supplemental shroud.

2. The system as set forth in claim 1 further comprising:

a secondary sweeper assembly adapted to clean a curb, the secondary sweeper assembly comprising a supplemental housing laterally spaced with respect to the primary sweeper assembly, a supplemental axle having cables constructed with frayed ends and in a helical configuration as is the primary sweeper assembly and a turbine configured as are the turbines on the primary axle, wherein the supplemental housing has an aperture in fluid communication with a tertiary tube for carrying away debris swept into the housing and has a vertical pivot pin supporting the optional sweeper assembly.

3. The system as set forth in claim 2 and further including:

a rotatable trimmer secured to the supplemental axle adjacent to the supplemental housing to cut soil and grass and weeds adjacent to the curb being swept.

4. The system as set forth in claim 1 further comprising:

a chamber within the container having a collection tube receiving the debris from the primary and secondary tubes and a primary filter within the chamber adjacent to the collection tube formed of a first and second open-cell foam block to entrap smaller particles of debris and to allow larger particles to fall to the bottom of the housing, the foam blocks having an apertured spacer in an accordion shape there between.

5. The system as set forth in claim 4 further comprising:

a final filter assembly with an opening in the upper rearward extent of the container with an electrostatic filter to entrap particulate matter which would otherwise be conveyed to the atmosphere, the container also including a vertical baffle extending downwardly from the top of the container to separate the foam blocks from the electrostatic filter.

6. A gutter street sweeper system for sweeping gutters and optionally sweeping the adjacent curb and trimming an edge there adjacent in a convenient and ecologically sound manner comprising, in combination:

a vehicle having a front with a cab for supporting an operator and a rear with a container for receiving swept and trimmed debris and with an intermediate section there between;

a primary sweeper assembly adapted to clean a gutter and having a horizontally disposed, cylindrically shaped rotatable primary axle with wound cables arranged in a helical configuration thereon, the cables having interior ends secured to and rotatable with the axle, the cables having exterior ends formed as tips of frayed cables;

a primary shroud secured to the vehicle on one side of the intermediate section and supporting the primary sweeper assembly, the primary shroud having an upper portion in a generally semi-cylindrical configuration with parallel front and rear portions and end portions, the end portions having aligned apertures supporting the axle adjacent to its ends;

a disk-shaped turbine mounted on each end of the primary axle within the primary shroud, each turbine including arcuate blades for creating a flow of air upwardly from the gutter being swept, wherein there is an opening in the primary shroud above one end of the axle in fluid communication with a primary tube there above to receive swept debris;

a supplemental shroud encompassing the primary shroud with a supplemental turbine within the supplemental shroud and coupled to and rotatable with the primary axle for the entrapment and conveying of dust from the gutter adjacent to the primary shroud, the supplemental shroud having a secondary aperture in fluid communication with a secondary tube there above;

a secondary sweeper assembly adapted to clean a curb the secondary sweeper assembly comprising having a supplemental housing laterally spaced with respect to the primary sweeper assembly, a supplemental axle having cables constructed with frayed ends and in a helical configuration as is the primary sweeper assembly and a turbine configured as are the turbines on the primary axle, wherein the supplemental housing has an aperture in fluid communication with a tertiary tube for carrying away debris swept into the housing and has a vertical pivot pin supporting the optional sweeper assembly;

a rotatable trimmer secured to the supplemental axle adjacent to the supplemental housing to cut soil and grass and weeds adjacent to the curb being swept;

a chamber within the container having a collection tube receiving the debris from the primary, secondary and tertiary tubes and a primary filter within the chamber adjacent to the collection tube formed of a first and second open-cell foam block to entrap smaller particles of debris and to allow larger particles to fall to the bottom of the housing, the foam blocks having an apertured spacer in an accordion shape there between; and a final filter assembly with an opening in the upper rearward extent of the container with an electrostatic filter to entrap particulate matter which would otherwise be conveyed to the atmosphere, the container also including a vertical baffle extending downwardly from the top of the container to separate the foam blocks from the electrostatic filter.

* * * * *